US005507964A

United States Patent [19]

Bongardt et al.

[11] Patent Number: 5,507,964

[45] Date of Patent: Apr. 16, 1996

[54] USE OF ISOPALMITIC ACID ESTERS AS LUBRICANTS FOR TWO-STROKE ENGINES

[75] Inventors: Frank Bongardt, Duesseldorf; Karl-Heinz Schmid, Mettmann; Reinhold Wuest, Kaarst, all of Germany

[73] Assignee: Henkel Kommanditgesellschaft auf Aktien, Duesseldorf, Germany

[21] Appl. No.: 199,204

[22] PCT Filed: Aug. 20, 1992

[86] PCT No.: PCT/EP92/01908

§ 371 Date: Mar. 18, 1994

§ 102(e) Date: Mar. 18, 1994

[87] PCT Pub. No.: WO93/05130

PCT Pub. Date: Mar. 18, 1993

[30] Foreign Application Priority Data

Aug. 29, 1991 [DE] Germany ..... 41 28 647.2

[51] Int. Cl.[6] ..... C10M 105/34; C10M 105/38; C10L 1/18

[52] U.S. Cl. ..... 252/56 S; 44/388

[58] Field of Search ..... 554/172, 227; 252/56 S; 44/388; C10M 105/34, 105/38

[56] References Cited

U.S. PATENT DOCUMENTS

| | | | |
|---|---|---|---|
| 3,048,608 | 8/1962 | Girard et al. | 554/227 |
| 4,053,491 | 10/1977 | Koch et al. | 260/410.6 |
| 4,234,497 | 11/1980 | Honig | 260/410.6 |
| 4,313,890 | 2/1982 | Chu et al. | 260/410.6 |
| 4,375,360 | 3/1983 | Washecheck et al. | 44/389 |
| 4,601,840 | 7/1986 | Zehler et al. | 252/56 S |
| 4,617,026 | 10/1986 | Shaub et al. | 44/389 |
| 5,378,249 | 1/1995 | Morrison | 44/388 |

FOREIGN PATENT DOCUMENTS

| | | |
|---|---|---|
| 566499 | 11/1958 | Canada . |
| 0286139 | 10/1988 | European Pat. Off. . |
| 2302918 | 7/1974 | Germany . |
| 3712133 | 10/1988 | Germany . |
| 4128646 | 8/1991 | Germany . |
| 270542 | 5/1988 | Japan . |
| 750560 | 6/1956 | United Kingdom . |
| 2237027 | 4/1991 | United Kingdom . |
| 9012849 | 11/1990 | WIPO . |

OTHER PUBLICATIONS

Ullmann Encyclopedia der Technischen Chemie, Band 11, 4 neubearbeitete Auflage, Verlag Chemie, Weinheim, 1976, pp. 91–93 (month unknown).

*Primary Examiner*—Prince Willis, Jr.
*Assistant Examiner*—Cephia D. Toomer
*Attorney, Agent, or Firm*—Wayne C. Jaeschke; John E. Drach; Henry E. Millson, Jr.

[57] ABSTRACT

The invention relates to the use of isopalmitic acid esters of branched aliphatic polyols containing 2 to 6 primary hydroxyl groups and 4 to 10 carbon atoms as a base oil for two-stroke engine lubricants. The isopalmitic acid esters are low in viscosity, even at low temperatures, and do not crystallize out in gasoline, even over periods of several days.

17 Claims, No Drawings

USE OF ISOPALMITIC ACID ESTERS AS LUBRICANTS FOR TWO-STROKE ENGINES

This application is a 371 PCT/EP92/01908, filed Aug. 20, 1992.

BACKGROUND OF THE INVENTION

1. Field of the Invention

This invention relates to the use of isopalmitic acid esters of branched aliphatic polyols containing 2 to 6 primary hydroxyl groups as a base oil for lubricants for two-stroke engines.

2. Statement of the Related Art

In two-stroke engines, the lubricant is generally supplied in admixture with the fuel and enters the combustion chamber through slots via the crank casing. The lubricant lubricates the crankshaft and the cylinder and, at the same time, participates in the combustion process. For lubricants for two-stroke engines, it is important that there should be no deposits in the combustion chamber nor any incrustations around the outlet slot because coke-like deposits in the outlet slot reduce the performance of the engine to such an extent that it can no longer operate satisfactorily. Since the lubricant also takes part in the combustion process, the formation of residues on the spark plugs must be avoided. Accordingly, base oils for two-stroke engine lubricants are expected to undergo complete combustion. In addition, the viscosities of the base oils should lie in certain ranges so that adequate lubrication is always guaranteed both at high temperatures and at low temperatures and even at high speeds. Users of two-stroke engine lubricants require base oils having viscosities in the range from 8 to 15 $mm^2 . s^{-1}$ at 100° C. in accordance with DIN 51 562, Part 1, and below 11,000 cP at −25° C. in accordance with ASTM D 2983. In addition, every base oil must be readily miscible with or soluble in gasoline over wide temperature ranges. Thus, no crystallization of the base oil should occur, even over periods of several days at low temperatures.

In principle, isopalmitic acid esters of branched alcohols are known as lubricants from DE-A 23 02 918. In view of their favorable low-temperature and viscosity behavior, they are recommended therein as sole constituents or, in admixture with mineral oils and ester oils, as hydraulic oils and, generally, as lubricants. Further particulars of applications are not provided although the field of lubricants is extensive and the requirement profile of lubricants differs considerably according to the particular application.

DE-A-37 12 133 describes lubricants based on mineral oil and/or synthetic oils containing polyol esters, such as pentaerythritol tetraisopalmitic acid ester. By virtue of the thermally stable polyesters, these lubricants are suitable for the permanent lubrication of heavily stressed engines, turbines, antifriction bearings and constant-velocity joints. The suitability of the lubricants for use in diesel engines and aircraft turbines is particularly emphasized. There is no reference to two-stroke engines as a potential application.

Commercially available base oils for two-stroke engine lubricants include inter alia the trimethylol propane esters of branched carboxylic acids marketed by Unichema under the name Priolube® 3999. Although Priolube® 3999 largely satisfies the requirement profile of two-stroke base oils, there is still a need for base oils for two-stroke engine lubricants which have lower viscosities at −25° C. (in accordance with ASTMD 2983) to guarantee improved lubrication during the cold-starting of two-stroke engines.

The problem addressed by the present invention was to provide base oils for two-stroke engine lubricants which would be miscible with gasoline and which would not have any tendency to crystallize, even at low temperatures. In addition, the base oils would not have any tendency to form unwanted residues or coke-like deposits during lubrication and combustion. Finally, they would have low viscosities, even at low temperatures (below 10,000 cP at −25° C. in accordance with ASTM D 2983).

DESCRIPTION OF THE INVENTION

The present invention relates to the use of isopalmitic acid esters of branched aliphatic alcohols containing 2 to 6 primary hydroxyl groups and 4 to 10 carbon atoms as a base oil for two-stroke engine lubricants.

In the context of the invention, lubricants are understood to be mixtures of base oils with additives; the base oil itself naturally has lubricating properties.

The isopalmitic acid esters according to the invention may be based on any branched aliphatic polyols containing 2 to 6 primary hydroxyl groups and 4 to 10 carbon atoms as the polyol component. Preferred isopalmitic acid esters are those of branched, aliphatic saturated polyols containing 2 to 6 primary hydroxyl groups and 4 to 10 carbon atoms, more particularly polyols of the type which contain tertiary carbon atoms adjacent the primary hydroxyl groups (i.e. polyols with no hydrogen atom), such as trimethylol ethane, trimethylol propane, trimethylol butane, pentaerythritol, neopentyl glycol and/or dipentaerythritol. Particular significance is attributed to the polyols neopentyl glycol, trimethylol propane, pentaerythritol and/or dipentaerythritol.

Isopalmitic acid is a commercially available product and may be produced, for example, by oxidation of the 2-hexyl decanol obtained from n-octanol by the Guerbet method. The isopalmitic acid produced by oxidation of 2-hexyl decanol has the following structure:

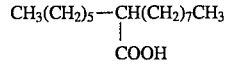

Isopalmitic acid can also be obtained by oxidation of branched alcohols from petroleum chemistry, for example by oxidation of an isomer mixture of branched $C_{16}$ alcohols having the following structure

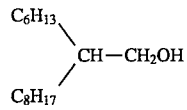

in which the $C_6H_{13}$ and $C_8H_{17}$ group are branched. Branched $C_{16}$ alcohols such as these may be obtained by aldol condensation of isooctyl aldehyde which, in turn, may be obtained from the isoheptane formed in the cracking of petroleum. Isopalmitic acid obtained by oxidation of 2-hexyl decanol, i.e. with an unbranched $C_6H_{13}$ and $C_8H_{17}$ group, is preferably used in accordance with the invention.

One embodiment of the present invention is characterized by the use of isopalmitic acid esters obtainable by esterification in known manner, for example by the method described in Ullmanns Encyklopädie der technischen Chemie, Vol. 11, 4th Revised Edition, Verlag Chemie, Weinheim, 1976, pages 91–93. In this process, the reactants isopalmitic acid and branched aliphatic polyols are generally reacted at temperatures of 160° to 260° C. in the presence of esterification catalysts, such as p-toluenesulfonic acid or tin grindings. Washing with short-chain alcohols may optionally be carried out as an aftertreatment to free the esters obtained from any acid esters. Any excess acid may of course also be removed by washing with alkalis.

One preferred embodiment of the present invention is characterized by the use of isopalmitic acid esters which have been produced by esterification of isopalmitic acid with polyol mixtures of 60 to 99.9% by weight aliphatic branched polyols containing 2 to 6 primary hydroxyl groups and 4 to 10 carbon atoms and 0.1 to 40% by weight, based on polyol mixture, of aliphatic, saturated, unbranched diols containing 2 to 12 carbon atoms, optionally in the presence of typical esterification catalysts. Particularly preferred isopalmitic acid esters are those of which the polyol mixture contains 75 to 99.9% by weight aliphatic branched polyols containing 2 to 6 primary hydroxyl groups and 4 to 10 carbon atoms and 0.1 to 25% by weight aliphatic, saturated unbranched diols containing 2 to 12 carbon atoms and, more particularly, 80 to 99.9% by weight aliphatic branched polyols and 0.1 to 20% by weight, based on polyol mixture, unbranched diols. Suitable aliphatic branched polyols have already been described. Preferred unbranched diols are those containing two primary hydroxyl groups, more particularly alpha, omega-diols, such as butane-1,4-diol, pentane-1,5-diol, hexane-1,6-diol and/or mixtures thereof. The esterification reaction may be carried out in known manner at the usual temperatures. The major advantage of polyol mixtures of aliphatic branched polyols and aliphatic unbranched diols of the described type in the quantities indicated lies above all in their faster esterification rate with the isopalmitic acid. In addition, the isopalmitic acid esters obtained have substantially the same advantages, such as lubricating properties, in their use as a base oil.

Accordingly, isopalmitic acid esters of polyol mixtures of 60 to 99.9% by weight and, more particularly, 80 to 99.9% by weight trimethylol propane, neopentyl glycol, pentaerythritol and/or dipentaerythritol and 0.1 to 40% by weight and, more particularly, 0.1 to 20% by weight butane-1,4-diol, pentane-1,5-diol, hexane-1,6-diol and/or mixtures thereof (the percentages by weight being based on the polyol mixture) are preferably used for the purposes of the invention.

If desired, the isopalmitic acid esters may be bleached in the usual way after their production, for example by wet bleaching in the presence of aluminium silicate as bleaching agent.

Isopalmitic acid esters which have been produced by complete or substantially complete esterification by any of the described methods are used for the purposes of the invention. Isopalmitic acid esters which have a residual acid value below 1.5 and, more particularly, below 1 and a residual hydroxyl value below 20 and, more particularly, below 10 are preferably used.

Irrespective of the method by which they are produced, the isopalmitic acid esters of branched aliphatic polyols containing 2 to 6 primary hydroxyl groups and, more particularly, the isopalmitic acid esters of trimethylol propane, pentaerythritol and/or dipentaerythritol are eminently suitable for use as a base oil for two-stroke engine lubricants. To this end, such additives as antioxidants, detergents and/or dispersants are generally added to the isopalmitic acid esters to guarantee long-term lubrication. The quantity of isopalmitic acid esters used in the two-stroke engine lubricant depends to a large extent on the effectiveness of the additives, but is generally between 50 and 99% by weight of the lubricant, the rest being additives.

The additive-containing base oils may readily be mixed with or dissolved in gasoline. Even at low temperatures, no crystallization of the base oil occurs for periods of several days, even in unleaded petrol.

Isopalmitic acid esters are used as a base oil in lubricants for air-cooled or water-cooled two-stroke engines, preferably for outboard engines, lawn mowers and two-wheeled vehicles.

EXAMPLES

EXAMPLE 1

Preparation of pentaerythritol tetraisopalmitic acid ester 941.55 kg technical isopalmitic acid (97% by weight isopalmitic acid; acid value 210–220, saponification value 210–220, iodine value <1), 18.83 kg 1,5-pentanediol and 138.28 kg technical pentaerythritol (88–90% by weight pentaerythritol, 10–12% by weight dipentaerythritol) were introduced into a reactor and the moisture present was removed. 0.33 kg tin oxalate was then added as esterification catalyst and the contents of the reactor were esterified under nitrogen at temperatures of 180° C. to 240° C. to a residual acid value of <1. The product obtained was then bleached with 5.00 kg aluminium silicate and filtered off.

A clear yellow liquid having the following characteristic data was obtained: acid value <1 (DIN 53 402), saponification value 195 (DIN 53 401), hydroxyl value 15 (DIN 53 240), iodine value <1 (DGF CV, 11b), kinematic viscosity 75 $mm^2/s$ at 40° C. and 10.6 $mm^2/s$ at 100° C. (DIN 51 562, Part 1).

EXAMPLE 2

Production of trimethylol propane triisopalmitic acid ester 969.00 kg technical isopalmitic acid, 172.00 kg trimethylol propane and 20.00 kg 1,5-pentanediol were introduced into a reactor and the moisture present was removed. 0.33 kg tin oxalate was then added as esterification catalyst and the contents of the reactor were esterified under nitrogen at temperatures of 180° C. to 240° C. to a residual acid value of <1.

The product obtained was then bleached with 5.00 kg aluminium silicate and filtered off.

A clear light yellow liquid having the following characteristic data was obtained: acid value <1, saponification value approx. 186, iodine value <1, hydroxyl value <10, kinematic viscosity 52 $mm^2/s$ at 40° C. and approx. 3.0 $mm^2/s$ at 100° C.

COMPARISON EXAMPLE 1

Preparation of trimethylol propane triisostearate 1001.4 kg isostearic acid, 157.4 kg trimethylol propane and 0.3 kg tin oxalate were introduced into a reactor and esterified under nitrogen at temperatures of 170° to 240° C. to a residual acid value of <1.

The product obtained was bleached with 3.00 kg aluminium silicate and filtered off.

A clear reddish-yellow liquid having the following characteristic data was obtained: acid value <1, saponification value approx. 170, iodine value approx. 10, hydroxyl value approx. 5, kinematic viscosity 115 $mm^2/s$ at 40° C. and 14.5 $mm^2/s$ at 100° C.

Performance tests

1. Determination of Brookfield viscosity at −25° C. in accordance with ASTM D 2983

| Product according to | Viscosity at −25° C. in cP |
|---|---|
| Example 1 | 5440 |
| Example 2 | 3840 |
| Comparison Example | 11000 |

It can clearly be seen that the isopalmitic acid ester has a very much lower viscosity than the isostearic acid ester.

2. Solubility in gasoline 5 g isopalmitic acid ester according to Examples 1 and 2 and 100 ml gasoline (boiling range 140°–200° C.) were separately stored for 16 hours at −25° C., subsequently introduced together into a vessel and mixed by gentle shaking. The isopalmitic acid esters dissolved clearly. The solution was then stored for 48 hours at −25° C. No crystallization was observed. The same results were also observed in a BP lead-free normal gasoline.

What is claimed is:

1. In a mixture of gasoline and a lubricant for use in a two-stroke engine, the improvement wherein the lubricant comprises a lubricating quantity of an isopalmitic acid ester wherein the ester group is a polyol having from 2 to 6 primary hydroxyl groups and from 4 to 10 carbon atoms.

2. The mixture of claim 1 wherein the isopalmitic acid in the isopalmitic acid ester has the formula $$CH_3(CH_2)_5-\underset{\underset{COOH}{|}}{CH}(CH_2)_7CH_3.$$

3. The mixture of claim 1 wherein the isopalmitic acid ester has a residual acid value below 1.5 and a residual hydroxyl value below 20.

4. The mixture of claim 3 wherein said residual acid value is below 1 and said residual hydroxyl value is below 10.

5. In a process for preparing a mixture of gasoline and lubricant for use in a two-stroke engine, the improvement wherein a lubricating quantity of an isopalmitic acid ester wherein the ester group is a polyol having from 2 to 6 primary hydroxyl groups and from 4 to 10 carbon atoms is added to the gasoline.

6. In the operation of a two-stroke engine, the improvement wherein the mixture of claim 1 is used to operate the engine.

7. In the operation of a two-stroke engine, the improvement wherein the mixture of claim 2 is used to operate the engine.

8. In the operation of a two-stroke engine, the improvement wherein the mixture of claim 3 is used to operate the engine.

9. In a mixture of gasoline and a lubricant for use in a two-stroke engine, the improvement wherein the lubricant comprises a lubricating quantity of an isopalmitic acid ester wherein the ester group is a polyol mixture comprised of: (a) from 60% to 99.9% by weight of at least one branched aliphatic polyol having from 2 to 6 primary hydroxyl groups and from 4 to 10 carbon atoms; and, (b) from 0.1% to 40% by weight of at least one aliphatic, saturated unbranched diol having from 2 to 12 carbon atoms.

10. The mixture of claim 9 wherein from 75 to 99.9% of said polyol mixture is component (a) and from 0.1 to 25% of said polyol mixture is component (b).

11. The mixture of claim 9 wherein from 80 to 99.9% of said polyol mixture is component (a) and from 0.1 to 20% of said polyol mixture is component (b).

12. The mixture of claim 9 wherein component (a) is at least one of trimethylol ethane, trimethylol propane, trimethylol butane, pentaerythritol, neopentyl glycol, or dipentaerythritol.

13. The mixture of claim 9 wherein component (b) is at least one of 1,4-butanediol, 1,5-pentanediol, or 1,6-hexanediol.

14. The mixture of claim 9 wherein said polyol is a mixture comprised of: (a) from 60% to 99.9% by weight of at least one of trimethylol propane, pentaerythritol, neopentyl glycol, or dipentaerythritol, and (b) 0.1% to 40% by weight of at least one of 1,4-butanediol, 1,5-pentanediol, or 1,6-hexanediol.

15. In the operation of a two-stroke engine, the improvement wherein the mixture of claim 9 is used to operate the engine.

16. In the operation of a two-stroke engine, the improvement wherein the mixture of claim 10 is used to operate the engine.

17. In the operation of a two-stroke engine, the improvement wherein the mixture of claim 12 is used to operate the engine.

* * * * *